United States Patent [19]

Suzuki et al.

[11] 4,401,754

[45] Aug. 30, 1983

[54] SILVER HALIDE PHOTOGRAPHIC EMULSION

[75] Inventors: Akio Suzuki; Hiroaki Shiozawa; Takeo Koitabashi; Hideki Takiguchi, all of Hino, Japan

[73] Assignee: Konishiroku Photo Industry Co., Ltd., Tokyo, Japan

[21] Appl. No.: 316,566

[22] Filed: Oct. 30, 1981

[30] Foreign Application Priority Data

Nov. 11, 1980 [JP] Japan ..... 55-158991

[51] Int. Cl.[3] ..... G03C 1/28; G03C 1/34

[52] U.S. Cl. ..... 430/599; 430/603; 430/604; 430/605; 430/607; 430/940

[58] Field of Search ..... 430/566, 599, 607, 940; 930/605, 604, 603

[56] References Cited

U.S. PATENT DOCUMENTS

| | | | |
|---|---|---|---|
| 3,915,715 | 10/1975 | Millikan et al. | 430/599 |
| 4,175,968 | 11/1979 | Credner et al. | 430/599 |
| 4,252,893 | 2/1981 | Iwamuro et al. | 430/607 |
| 4,268,621 | 5/1981 | Ogi et al. | 430/599 |
| 4,299,909 | 11/1981 | Imatomi et al. | 430/566 |

*Primary Examiner*—J. Travis Brown

*Attorney, Agent, or Firm*—Jordan B. Bierman; Linda Bierman

[57] ABSTRACT

A silver halide photographic emulsion characterized in that it comprises silver halide grains which are reduction-sensitized during the process of growing said grains and containing a compound of the formula General Formula [I]

wherein $R_1$ and $R_2$ are selected from the group consisting of a hydrogen atom, an alkyl group, an alkenyl group, an aryl group, an acyl group and a cycloalkyl group and $R_3$, $R_4$, $R_5$ and $R_6$ are selected from the group consisting of a hydrogen atom, a halogen atom, a hydroxy group, an alkyl group, an alkenyl group, a cycloalkyl group, an aryl group, an alkoxy group, an acyl group, a carboxyl group, an aldehyde group, an amino group, a sulfo group, an alkylthio group, an acylamino group, an aryloxy group, an arylthio group, an alkylamino group, an alkoxycabonyl group and a sulfonamide group. The emulsion exhibits both high sensitivity and improved stability as compared with prior art compositions.

18 Claims, No Drawings

SILVER HALIDE PHOTOGRAPHIC EMULSION

The present invention relates to the silver halide emulsion having high sensitivity and excellent preservability.

In recent years, a highly sensitive silver halide photographic material has been required. For example, as for films for amateur use a high shutter speed has been required for the purpose of eliminating a picture blur resulted from miniaturizing a film frame size, and as to color and black-and-white photoprinting papers a rapid processing is required, and as to photosensitive materials for the graphic arts use a high sensitivity is required from the view points of the adoption of electronics and the simplification in a printing process, also as to X-ray photosensitive materials the reduction of radiation dose is strongly requested.

Quite recently, it is emphatically required to save silver because silver price has been sharply raised. To satisfy this requirement it is indispensable to establish a technology for increasing the sensitivity.

As for the technology for increasing the sensitivity, there have so far been known the chemical sensitizing in the individual use or for a joint thereof, for example, sulfur sensitizing, noble metal sensitizing such as gold, palladium, platinum and iridium sensitizing, selenium sensitizing and reduction sensitizing.

Among the above chemical sensitization, reduction sensitization has been well known as described in Japanese Patent Publication Open to Public Inspection No. 87825/1973 for example, that this sensitization can be one of the most promising chemical sensitizing technologies, if this is used jointly with gold and/or sulfur sensitization.

However, it has also been known that the silver halide photosensitive emulsions which were highly sensitized by the reduction sensitization have the serious defects that the photographic materials will result in desensitization and soft gradation during the preservation. It has been considered that the above-mentioned defects are caused from the fact that the said silver halide photosensitive emulsions are thermally unstable because the sensitized nuclei produced by reduction sensitizing are the fine silver nuclei in which several silver atoms were cohered together.

Among persons skilled in the art, it has been well known the facts that the said reduction sensitization is inferior in itself in preservability in spite of its high sensitivity and that the preservability thereof cannot be fitted for the practical use.

Accordingly, it is an object of the invention is to provide a silver halide photosensitive emulsion having a high sensitivity and an improved preservability and a producing method thereof.

It is another object of the invention is to provide a means for improving the preservability of a silver halide photosensitive emulsion highly sensitized by reduction sensitizing.

Other and further objects of the invention will appear from the description of the present specification.

The object of the present invention may be achieved by a silver halide photographic emulsion comprising silver halide grains reduction-sensitized in a process of growing the silver halide grains and the compound represented by the following general formula [I], General Formula [I]

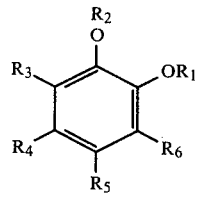

(wherein $R_1$ and $R_2$ are selected from the group consisting of a hydrogen atom, an alkyl group, an alkenyl group, an aryl group, an acyl group and a cycloalkyl group and $R_3$, $R_4$, $R_5$ and $R_6$ are selected from the group consisting of a hydrogen atom, a halogen atom, a hydroxy group, an alkyl group, an alkenyl group, a cycloalkyl group, an aryl group, an alkoxy group, an acyl group, a carboxyl group, an aldehyde group, an amino group, a sulfo group, an alkylthio group, an acylamino group, an aryloxy group, an arylthio group, an alkylamino group, an alkoxycarbonyl group and a sulfoamide group.)

These groups may be substituted by group such as halogen atom, hydroxy group, carboxy group, sulfo group, cyano group, alkyl group, alkenyl group, alkoxy group, alkylthio group, alkenyloxy group, alkenylthio group, aryl group, arylthio group, arylamino group, alkylamino group, alkenylamino group, acyl group, acyloxy group, acylamino group, carbamoyl group, sulfonamide group, sulfamoyl group, alkoxycarbonyl group and aryloxycarbonyl group.

Alkyl groups represented by the characters, $R_1$–$R_6$ in General Formula [I] may be of either the straight chained or the branch-chained, preferably be the one having 1–32 carbon atoms, for example, methyl, ethyl, n-butyl, 1-butyl, 3,5,5,-trimethyl hexyl, n-octyl, and n-dodecyl are given.

Alkenyl groups represented by $R_1$–$R_6$ may be of either the straight-chained or the branch-chained, preferably be the ones having 1–32 carbon atoms, for example, alkyl, butynyl, octenyl and olenyl are given. As for aryl group represented by $R_1$–$R_6$, phenyl and naphthyl are given. Similarly, as for acyl group, acetyl, butanoyl, dodecanoyl, benzoyl and cinnamoyl are given. As for cycloalkyl group, the one having 5–7 members is preferable, for example, cyclopentyl and cyclohexyl are given, respectively.

As for halogen atom represented by $R_3$–$R_6$, fluorine, chlorine, bromine and iodine are given as the example. As for alkoxy group, methoxy, ethoxy and t-butoxy are given. As for alkylthio group, methylthio and n-dodecylthio are given. As for aryloxy groups, phenoxy and naphthoxy are given. As for arylthio group, phenylthio is given. As for acylamino group, acetylamino, octanoylamino and benzoylamino are given. As for alkylamino group, methylamino, diethylamino and isopropylamino are given. As for alkoxycarbonyl group, methoxycarbonyl and ethoxycarbonyl are given. As for sulfonamide groups, methyl sulfonamide and phenyl sulfonamide are given, respectively.

The following example shown in Table 1 are exemplary of the chemical compound of the invention formulated in General Formula [I]; however these examples are not to be construed to limit the scope of the invention.

TABLE-1
Compound example:
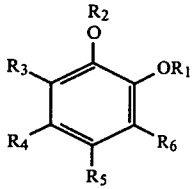
| No. | $R_1$ | $R_2$ | $R_3$ | $R_4$ | $R_5$ | $R_6$ |
|---|---|---|---|---|---|---|
| 1 | —H | —H | —H | —H | —H | —H |
| 2 | —H | —H | $-CH_3$ | —H | —H | —H |
| 3 | —H | —H | $-C_2H_5$ | —H | —H | —H |
| 4 | —H | —H | $-OCH_3$ | —H | —H | —H |
| 5 | —H | —H | $-OC_2H_5$ | —H | —H | —H |
| 6 | —H | —H | —COOH | —H | —H | —H |
| 7 | —H | —H | $-COOCH_3$ | —H | —H | —H |
| 8 | —H | —H | $-COCH_3$ | —H | —H | —H |
| 9 | —H | —H | $-CH_2-CH=CH_2$ | —H | —H | —H |
| 10 | —H | —H | $-C_{15}H_{31}$ | —H | —H | —H |
| 11 | —H | —H | 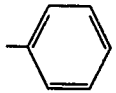 | —H | —H | —H |
| 12 | —H | —H | —CO— 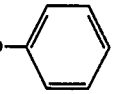 | —H | —H | —H |
| 13 | —H | —H | $-CONH_2$ | —H | —H | —H |
| 14 | —H | —H | —Cl | —H | —H | —H |
| 15 | —H | —H | $-CH_2COOH$ | —H | —H | —H |
| 16 | —H | —H | $-SO_2-$ 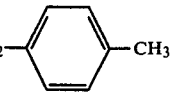 $-CH_3$ | —H | —H | —H |
| 17 | —H | —H | $-CH_2OH$ | —H | —H | —H |
| 18 | —H | —H | —H | $-CH_3$ | —H | —H |
| 19 | —H | —H | —H | $-NH_2$ | —H | —H |
| 20 | —H | —H | —H | $-C(CH_3)_3(t)$ | —H | —H |

TABLE-1-continued
Compound example:
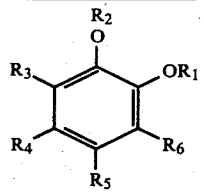
| No. | $R_1$ | $R_2$ | $R_3$ | $R_4$ | $R_5$ | $R_6$ |
|---|---|---|---|---|---|---|
| 21 | —H | —H | —H | 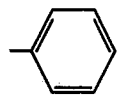 | —H | —H |
| 22 | —H | —H | —H | $-SO_3H$ | —H | —H |
| 23 | —H | —H | —H | —Br | —H | —H |
| 24 | —H | —H | —H | $-CH(CH_3)-CH_2-CH_3$ | —H | —H |
| 25 | —H | —H | —H | $-CH_2-CH(NH_2)-CH_3$ | —H | —H |
| 26 | —H | —H | —H | 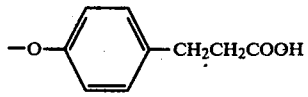 | —H | —H |
| 27 | —H | —H | —H | 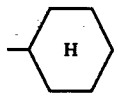 | —H | —H |
| 28 | —H | —H | —H | —CHO | —H | —H |
| 29 | —H | —H | —H | $-(CH_2)_3CH_3$ | —H | —H |
| 30 | —H | —H | $-CH_3$ | $-CH_3$ | —H | —H |
| 31 | —H | —H | —OH | $-CH_2-CO-CH_3$ | —H | —H |
| 32 | —H | —H | $-CH_3$ | —H | $-CH_3$ | —H |
| 33 | —H | —H | —Br | —H | $-CH_3$ | —H |
| 34 | —H | —H | —OH | —H | —COOH | —H |
| 35 | —H | —H | $-OCH_3$ | —H | $-COCH_3$ | —H |
| 36 | —H | —H | —OH | —H | —OH | —H |
| 37 | —H | —H | $-OCH_3$ | —H | —Cl | —H |

TABLE-1-continued
Compound example:
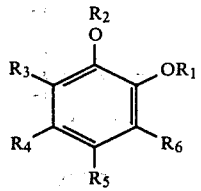
| No. | $R_1$ | $R_2$ | $R_3$ | $R_4$ | $R_5$ | $R_6$ |
|---|---|---|---|---|---|---|
| 38 | —H | —H | —OH | —H | 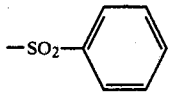 | —H |
| 39 | —H | —H | —C(CH$_3$)$_3$(t) | —H | —CH$_3$ | —H |
| 40 | —H | —H | —CH$_3$ | —H | 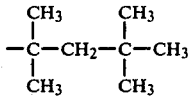 | —H |
| 41 | —H | —H | —OCH$_3$ | —H | —H | 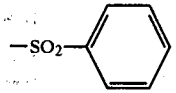 |
| 42 | —H | —H | —CH$_3$ | —H | —H | 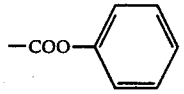 |
| 43 | —H | —H | —OH | —H | —H | —NH$_2$ |
| 44 | —H | —H | —OH | —H | —H | —OH |
| 45 | —H | —H | —H | —Br | —COOH | —H |
| 46 | —H | —H | —H | —CH$_3$ | —CH$_3$ | —H |
| 47 | —H | —H | —H | —CH$_3$ | —C(CH$_3$)$_3$(t) | —H |
| 48 | —H | —H | —CH$_3$ | —OH | —H | —CH(CH$_3$)$_2$ |
| 49 | —H | —H | —OH | —OH | —H | —OH |
| 50 | —H | —H | —OH | —NH$_2$ | —H | —NH$_2$ |
| 51 | —H | —H | —OCH$_3$ | —OCH$_3$ | —H | —CH$_3$ |
| 52 | —H | —H | —OH | —COCH$_3$ | —H | 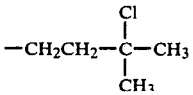 |

TABLE-1-continued

Compound example:

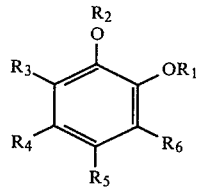

| No. | $R_1$ | $R_2$ | $R_3$ | $R_4$ | $R_5$ | $R_6$ |
|---|---|---|---|---|---|---|
| 53 | $-CH_3$ | $-CH_3$ | $-H$ | $-H$ | $-H$ | $-H$ |
| 54 | $-CH_3$ | $-H$ | $-H$ | $-H$ | $-H$ | $-H$ |
| 55 | $-CH_3$ | $-H$ | $-H$ | $-Cl$ | $-H$ | $-Cl$ |
| 56 | $-H$ | $-H$ | $-CH_3$ | $-OH$ | $-OCH_3$ | $-OCH_3$ |
| 57 | $-H$ | $-H$ | $-OH$ | $-Cl$ | $-CH_3$ | 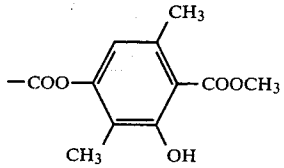 |
| 58 | $-CH_3$ | $-CH_3$ | $-H$ | $-Br$ | $-COOH$ | $-H$ |
| 59 | $-CH_3$ | $-CH_3$ | $-H$ | $-H$ | $-H$ | $-CH_2CH_2COOH$ |
| 60 | $-C_2H_5$ | $-H$ | $-H$ | $-H$ | $-H$ | $-CHO$ |
| 61 | $-CH_3$ | $-H$ | $-H$ | $-CH_2CH_2NH_2$ | $-OH$ | $-H$ |
| 62 | 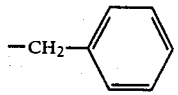 | 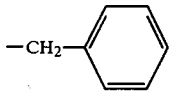 | $-H$ | $-CH(OH)-CH(NH_2)-CH_3$ | $-H$ | $-H$ |
| 63 | 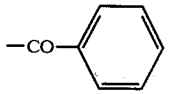 | $-H$ | $-H$ | $-H$ | $-NH_2$ | $-H$ |
| 64 | $-COCH_3$ | $-COCH_3$ | $-C(CH_3)_3(t)$ | $-H$ | $-C(CH_3)_3(t)$ | $-H$ |
| 65 | $-C_2H_5$ | $-H$ | $-H$ | $-H$ | $-CH=CH-CH_3$ | $-H$ |
| 66 | $-H$ | $-H$ | $-COOC_2H_5$ | 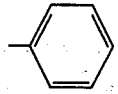 | 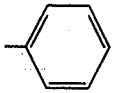 | 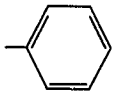 |

TABLE-1-continued
Compound example:
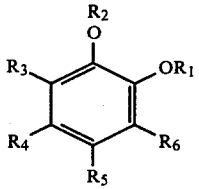
| No. | $R_1$ | $R_2$ | $R_3$ | $R_4$ | $R_5$ | $R_6$ |
|---|---|---|---|---|---|---|
| 67 | $-C_2H_5$ | $-H$ | $-CH_3$ | $-H$ | $-C(CH_3)_3(t)$ | $-H$ |
| 68 | $-CH_2CH{=}CH_2$ | $-H$ | $-H$ | $-H$ | $-H$ | $-H$ |
| 69 | 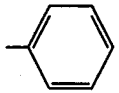 | $-H$ | $-H$ | $-H$ | $-H$ | $-H$ |
| 70 | 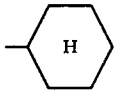 | $-H$ | $-H$ | $-H$ | $-H$ | $-H$ |
| 71 | $-H$ | $-H$ | $-OCH_3$ | $-H$ | $-H$ | 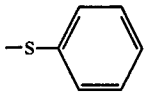 |
| 72 | $-H$ | $-H$ | $-OCH_3$ | $-H$ | $-H$ | $-SO_2NH_2$ |
| 73 | $-H$ | $-H$ | $-OCH_3$ | $-H$ | $-H$ | $-S-CH_3$ |

The above compounds can easily be synthesized through such a process as described in Eugen Muller, "Methoden der Organischer Chemie," 4th ed., Georg Thieme, 1976, Bd. 6/Ic, and can also be procured on the regular market.

Herein, the expression, "reduction-sensitized in a process of growing the silver halide grains" means not only that silver halide grains are reduction-sensitized in the state where they are being grown in a manufacturing process, but also that they are reduction-sensitized in the state where they are not grown, but the grains having already been reduction-sensitized are grown thereafter in a manufacturing process. In other words, it is to be understood that that silver halide grains reduction-sensitized in a process of growing the silver halide grains contain the silver halide grains which have been prepared through the manufacturing process including the process wherein reduction-sensitized silver halide grains are grown.

The reduction sensitization in a process of growing the silver halide grains abovementioned produces a silver nuclei in the interior of a silver halide grain. This silver nuclei is capable of scavenging a positive hole generated by light absorption.

The reduction sensitization of the invention are preferred by adding reducing agent and/or water-soluble silver salt into silver halide emulsion so that the silver halide grains in silver halide emulsion can be reduction-sensitized in a process of their growing.

As for the preferable reducing agents, thiourea dioxide and stannous chloride are given, and it is suitable to use the former, or the latter, at the ratio of approx. 0.01 mg–approx. 2 mg, or approx. 0.01 mg–approx. 3 mg respectively per mol of silver halide. Other suitable reducing agents include polyamines such as hydrazine and diethylene triamine, and sulfites.

As for water-soluble silver salts, silver nitrate is preferable and the so-called silver ripening, which is included in reduction sensitization, is performed by adding water-soluble silver salt. The suitable value of pAg in silver ripening is 1–6, particularly 2–4 (herein, the value of pAg is a common logarithm of the reciprocal of $Ag^+$ concentration.)

As for the conditions of reduction sensitization, the preferable scopes are approx. 30° C.–80° C. for temperature, approx. 10 min–200 min. for time, approx. 5–11 for pH and approx. 1–10 for pAg.

At any arbitrary time before, during or after the said reduction sensitization, an emulsion may be added with the following chemical sensitizers; sulfur sensitizers such as sodium thiosulfate and thiourea; noble metal sensitizers such as gold sensitizers of which chloroaurate and gold trichloride are given in the concrete, and palladium sensitizers of which palladium chloride and chloropalladiate are given in the concrete, platinum compounds and iridium compounds; and selenium sensitizers such as selenious acid and selenourea; and one or more kinds of these sensitizers may be added in an emulsion.

From the viewpoint of obtaining high sensitivity, it is preferable that the reduction-sensitized emulsions of the invention are to be gold- and/or sulfur-sensitized after the completion of desalting process.

Reduction sensitization is also possible after the completion of the above mentioned gold- and/or sulfur-sensitization.

The compounds formulated by General Formula [I] of the invention (hereinafter referred to as the compound of the invention) are to be contained in silver halide photographic emulsion containing the reduction sensitized silver halide grains of the invention, and as for the containing processes, it can be done through either the process in which the compounds of the invention are to be contained directly into the said emulsion or the process in which the said compounds are to be added in a composite for coating use such as a layer (e.g., a protective layer, irradiation prevention layer, filter layer or other interlayers) adjoining said emulsion layer in a photosensitive material and then to be contained in said emulsion (that is the emulsion layer) through a coating process or by diffusion to be made thereafter.

For the purpose of containing the compounds of the invention into the aforementioned constituent layer of a silver halide photosensitive material, it is advantageous to add the compounds of the invention in form of solution into the coating composites for the said constituent layer use. As for the solvents to be used for this purpose, there are given a variety of solvents, among those of which aqueous or hydrate organic solvents not having a bad influence upon silver halide emulsions or others are preferable, for instance, methanol, ethanol, isopropyl alcohol, alcohol fluoride, ethylene glycol monomethyl ether, dimethyl formaldehyde and acetonitrile, and the compounds of the invention may be dissolved in the single or mixed solvent as above given.

In the case of adding the compounds of the invention into silver halide emulsions, the timing of adding thereof depends upon the kinds and purposes of a photosensitive materials having a photosensitive layer coated with the said silver halide emulsions, however it will do essentially to add the said compounds of the invention at any time and stage for preparing a silver halide emulsion, nevertheless, it is not preferable to add the said compounds before the desalting because the compounds are eluted by the desalting but preferable to add after the secondary ripening was completed.

As for the timing for adding the said compounds into a coating composite for a constituent layer use contained with silver halide emulsions, the timing just prior to the coating is more preferable.

The amount added of the compound of the invention varies according to the kinds of silver halide to be used in a silver halide photographic emulsion, the grain diameters or crystal habits of silver halide, the presence of other additives for photographic use such as stabilizers and sensitizing coloring-matters, temperatures for processing said silver halide photographic emulsion, or compositions of a processing solution. However the amount added of the compounds is generally 1 mg–10 g per mol of silver halide, preferably 10 mg–2 g.

In the case of adding the compound of the invention in silver halide emulsion, an excellent preservability can be obtained by adding either only one kind of said compound or more than two kinds of them.

Also, it can do without any trouble to make the compounds of the invention coexist at the same time in silver halide photographic emulsion with other additives to be added for the purpose of preventing from producing fogs and lowering the sensitivity in the preparing process, preservation period and the processing steps of silver halide photographic emulsions. As for the said other compounds, any of the additive publicly well-known in persons skilled in the art can be used including the famous compounds such as 4-hydroxy-6-methyl-1,3,3a,7-tetrazaindene, 5-mercapto-1-phenyl tetrazole, and 2-mercaptobenzothiazole.

The working effects of the invention cannot be obtained until the compounds of the invention are combinedly used with silver halide grains to be used in the invention, however it is impossible to obtain the similar effects even if used a compound of which structure is similar to the ones of the invention, such as hydroquinone compound or resorcinol compound.

The silver halide grains to be used in the invention can be prepared by applying the process such as neutral processes as described in the literature such as T. H. James, "The Theory of the Photographic Process" 4th ed., Macmillan, 1977, pp. 88–104, acid processes, ammonia processes, regular order mixing, inverse order mixing, double-jetting processes, controlled-double jetting processes, conversion processes, and core/shell processes. As for the compositions of silver halide, anyone of silver chloride, silver bromide, silver chlorobromide, silver iodobromide, silver chloroiodobromide and so on can be used.

There is no particular limitation of silver halide grains in the sizes, distribution, crystal habits, forms (e.g., regular crystal form and twinned crystal form), etc., however the grains having the comparatively uniform diameters of 0.1–2$\mu$ are preferable. And in these silver halide grain or in silver halide emulsion, iridium salts and/or rhodium salts may also be contained therein for improving the flash-exposure characteristics thereof.

Further, they can be optically sensitized in the desired wave-length range as occasion demands by making use of optical sensitizers such as cyanine and merocyanine sensitizing dyes independently or jointly.

For example the sensitizing dyes described in the following U.S. Patents can be used; U.S. Pat. Nos. 2,493,784, 2,519,001, 2,977,229, 2,480,343, 3,672,897, 3,703,377, 2,688,545, 2,912,329, 3,397,060, 3,511,664, 3,522,052, 3,527,641, 3,615,613, 3,615,632, 3,615,635, 3,615,641, 3,617,295, 3,617,293, 3,628,964, 3,635,721, 3,656,959, 3,694,217, 3,743,510, 3,769,301, 3,793,020.

As for the vehicles for silver halide photographic emulsions of the invention, gelatin, gelatin derivatives, synthesized hydrophilic polymers can be used and a variety of the additives for photographic use can also be contained therein.

As for the hardening agents, aldehyde compounds, ketone compounds, halogen substituted acids such as mucochloric acid, ethylene imine compounds, vinyl sulfonic compounds, etc. can be used. As for the spreading agents, saponin, lauryl or oleyl monoether, etc. are used.

As for the development accelerating agents, there is no particular limitation and the compounds such as benzimidazole (for example, the one described in Japanese Patent Open to Public Inspection No. 24427/1974) and quaternary ammonium salts can be used.

As for the physical property improving agents, there can be contained with polymer latexes comprising homo- or copolymers such as alkylacrylate, alkylmethacrylate and acrylic acids.

And the silver halide photographic emulsions relating to the invention can be added with an antistatic agent such as the compounds obtained by addition-copolymerizing glycidol and ethylene oxide with phenol aldehyde condensation products (e.g., the antistatic agents described in Japanese Patent Open to Public Inspection No. 56220/1976), lanolin ethylene oxide addition products and alkaline metal salts and/or alkaline earth metal salts (e.g., Japanese Patent Application No. 145022/1978), water-soluble inorganic chlorides and matting agents (Japanese Patent Open to Public Inspection No. 161230/1980), addition condensation products obtained by addition-condensing glycidol and ethylene oxide with phenol aldehyde condensation products, and fluorine containing succinic acid compounds (e.g., Japanese Patent Open to Public Inspection No. 48520/1979).

Further, pH adjusting agent, thickening agent, graininess improving agent, matting agent, etc. can be contained therein. Besides, it is not preferable to contain a strong oxidizing agent in the photographic emulsions of the invention.

In the case that the photographic emulsions of the invention are applied to a silver halide color photographic sensitive material, no defect is caused at all even if the photographic emulsion of the invention is made co-exist with anyone of a variety of constituent factors of said photosensitive materials which are others than the various additives given above and well-known by the engineers skilled in the art. As for the examples of the constituent factors falling under the category thereof, there are given the compounds, wherein coloring matters are produced by reacting with an oxidized developing agent, that is, the so-called antidiffusion type couplers. More in detail, yellow couplers which are typified by diketomethyl couplers, magenta couplers typified by 5-pyrazolone couplers, and cyan couplers typified by phenol or naphthol couplers, and besides, there are alos given the so-called DIR couplers which discharge a developing inhibitor on a coloring reaction, and the so-called colored couplers which adjust a masking-density. There have been exemplified in "Research Disclosure" (R.D.) 9232.

As for the kinds of silver halide photographic sensitive materials to which the photographic emulsions of the invention are applicable, anyone of color printing papers, color negative films, color positive films or black-and-white films (e.g., photosensitive material for X-ray use or for printing use), diffusion transfer type photosensitive materials, or the like, will do.

A photo-exposure of the photographic emulsions relating to the invention depends upon the states of an optical sensitization, the purposes of using the said emulsion, however a variety of light sources can be used such as tungsten, fluorescent lamp, mercury lamp, arc lamp, xenon, sunlight, xenon flash, cathode-ray tube flying spot, laser beam, electron beam, X-ray, fluorescent screen for radiographic use and the like, can suitably be used, and the exposure time is normally at $1/10^3$–100 seconds and besides, with a xenon flash, cathode-ray tube, or laser beam, a rapid exposure to light of $1/10^4$–$1/10^9$ sec. can be applied to use.

Next, the more concrete description of the invention will be made referring to the examples, however it is to be understood that the present invention shall not be limited thereto.

EXAMPLE 1

Silver iodobromide emulsion containing 1.5 mol of silver iodide was prepared with being controlled at 60° C., pAg=8 and pH=2.0, through a double-jet process, and thus the monodispersed cubic emulsion having an average grain diameter of 0.5$\mu$ was obtained. Thus obtained emulsion was devided by two portions after desalted. One of the devided portion was added with silver nitrate solution and silver-ripened at 50° C., pAg=3, and pH=6, that was designated as Emulsion No. 1, and the other portion was not silver-ripened, that was designated as Emulsion No. 2.

Each of the emulsions was further added with silver nitrate solution and the solution containing potassium bromide and potassium iodide through a double-jet process and thus the grain of each emulsion was grown from 0.5μ up to 1.2μ in diameter. After desalted these two kinds of grains having the diameter of 1.2μ were gold-sensitized and fulfur-sensitived, and then Emulsion No. 2 only was further devided by two portion, and one of the portions was added with silver nitrate solution and silver-ripened at 50° C., pAg=4.5 and pH=6 and added further with potassium bromide solution. Thus obtained emulsion was designated as Emulsion No. 3.

The above three kinds of emulsion were respectively added with 4-hydroxy-6-methyl-1,3,3a,7-tetrazaindene, and devided and added with the compounds in the devided emulsion respectively.

The normal additives for photographic use such as spreading agent, thickening agent and hardening agent were added into these emulsions respectively. And then the emulsions obtained were respectively coated on a polyethylene terephthalate film base and dried up so that the amount of silver can become at the ratio of 50 mg/100 cm$^2$, through a conventional process, and thus Samples No. 1–12 were prepared.

Sensitometry of the each sample was performed as follows. The light source of the color temperature at 5400° K. was used for exposure with which exposure was made for the period of 1/50 sec. through an optical wedge. The amount of exposure to light was 3,2 C.M.S. Development was performed at 35° C. for 30 sec. by making use of the following Developer-1:

Developer-1

Sodium sulfite anhydrous: 70 g
Hydroquinone: 10 g
Boric acid anhydrous: 1 g
Sodium carbonate monohydrate: 20 g
1-phenyl-2-pyrazolidone: 0.35 g
Sodium hydroxide: 5 g
5-methyl-benzotriazole: 0.05 g
Potassium bromide: 5 g
Glularaldehyde hydrogensulfite: 15 g
Glacial acetic acid: 8 g
Add water to make: 1 ltr.

Sensitometric tests were performed with both samples immediately after coated and the samples heat-treated at 50° C. and 80% R.H. and for the period of 72 hours, respectively.

The results obtained are shown in Table-1. Sensitivities thereof are expressed in the values relative to that of Sample No. 1 immediately after coated taking the value of 100. In the table, the character, S, represents a sensitivity. Fog represents a fog density and γ represents a contrast grade.

TABLE-1

| Sample No. | Emulsion No. | Silver ripening inside the grains | Silver ripening on the grain surface | Compound added (mg/AgX mol) | | Developed immediately after coated | | | Developed after heat-treated | | |
|---|---|---|---|---|---|---|---|---|---|---|---|
| | | | | | | S | Fog | γ | S | Fog | γ |
| 1 | 1 | Yes | No | None | | 100 | 0.05 | 2.3 | 65 | 0.03 | 2.2 |
| 2 | " | " | " | Compound 1 | 300mg | 100 | 0.04 | 2.3 | 95 | 0.03 | 2.2 |
| 3 | " | " | " | Compound 2 | 300mg | 100 | 0.04 | 2.3 | 97 | 0.03 | 2.3 |
| 4 | " | " | " | Control compound A | 300mg | 95 | 0.04 | 2.3 | 60 | 0.03 | 2.2 |
| 5 | 2 | No | " | None | | 75 | 0.05 | 2.2 | 45 | 0.03 | 2.1 |
| 6 | " | " | " | Compound 1 | 300mg | 75 | 0.04 | 2.2 | 45 | 0.03 | 2.1 |
| 7 | " | " | " | Compound 2 | 300mg | 75 | 0.04 | 2.2 | 45 | 0.03 | 2.2 |
| 8 | " | " | " | Control Compound A | 300mg | 70 | 0.04 | 2.2 | 40 | 0.03 | 2.0 |
| 9 | 3 | " | Yes | None | | 92 | 0.06 | 2.2 | 55 | 0.09 | 2.0 |
| 10 | " | " | " | Compound 1 | 300mg | 90 | 0.05 | 2.2 | 58 | 0.05 | 2.1 |
| 11 | " | " | " | Compound 2 | 300mg | 90 | 0.05 | 2.2 | 57 | 0.05 | 2.1 |
| 12 | " | " | " | Control Compound A | 300mg | 88 | 0.05 | 2.2 | 53 | 0.06 | 2.0 |

Note:

Control compound A is formulated in

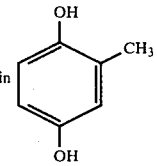

As is obvious from Table-1, a photographic emulsion of which the sensitivity and preservability have both been greatly improved can be obtained by containing the compound of the invention in silver halide emulsion in which reduction-sensitization was processed inside the silver halide grains thereof. In contrast with the above, such effects as above cannot be obtained from the samples in which the reduction-sensitization was processed on the silver halide grain surfaces or with the samples in which a compound other than but similar to those of the invention was used.

There has been obtained the similar results from the same experiment as performed in this example, except that silver ripening was replaced by thiourea dioxide.

EXAMPLE-2

In Emulsion No. 1 and No. 3 of Example-1, Compound No. 1 and No. 2 thereof were replaced by Compound No. 4, No. 14 and No. 20 and the emulsions thus prepared were coated on and then dried up, and thus Sample No. 13–No. 22 were obtained. Then, these samples were exposed to light and developed together with Sample No. 1 and No. 9 of Example-1 through the process similar to that taken in Example-1, and the preservability of each sample, in the capability for a photographic material, was tested.

The results obtained are shown in Table-2. Sensitivities thereof are expressed in the value relative to that of Sample No. 1 just after coated taking the value of 100.

TABLE-2

| Sample No. | Emulsion No. | Silver ripening | Compound added (mg/Ag mol) | | Developed just after coated S | Fog | γ | Developed after heat-treated S | Fog | γ |
|---|---|---|---|---|---|---|---|---|---|---|
| 1 | 1 | Inside of grain | None | | 100 | 0.05 | 2.3 | 65 | 0.03 | 2.2 |
| 13 | " | Inside of grain | Compound 4 | 200mg | 100 | 0.04 | 2.3 | 93 | 0.03 | 2.3 |
| 14 | " | Inside of grain | " | 500mg | 98 | 0.04 | 2.4 | 97 | 0.03 | 2.3 |
| 15 | " | Inside of grain | " | 1000mg | 96 | 0.03 | 2.5 | 100 | 0.02 | 2.4 |
| 16 | " | Inside of grain | Compound 14 | 200mg | 100 | 0.04 | 2.3 | 92 | 0.03 | 2.3 |
| 17 | " | Inside of grain | " | 500mg | 99 | 0.04 | 2.4 | 97 | 0.03 | 2.3 |
| 18 | " | Inside of grain | Compound 20 | 200mg | 100 | 0.04 | 2.3 | 93 | 0.03 | 2.3 |
| 19 | " | Inside of grain | " | 500mg | 98 | 0.04 | 2.4 | 96 | 0.03 | 2.3 |
| 9 | 3 | Grain surface | None | | 92 | 0.06 | 2.2 | 55 | 0.09 | 2.0 |
| 20 | " | Grain surface | Compound 4 | 500mg | 89 | 0.05 | 2.2 | 57 | 0.05 | 2.1 |
| 21 | " | Grain surface | Compound 14 | " | 90 | 0.05 | 2.1 | 58 | 0.05 | 2.1 |
| 22 | " | Grain surface | Compound 20 | " | 90 | 0.05 | 2.2 | 57 | 0.05 | 2.0 |

As is obvious from Table-2, there can be obtained a photographic emulsion of which the sensitivity is high and the preservability is greatly improved by making use of the compounds of the invention for silver halide emulsion in which reduction-sensitization was processed inside the silver halide grains thereof. On the other hand, such effects as above cannot be obtained with silver halide emulsion in which reduction-sensitization was processed.

There has been obrained the similar results from the same experiment as performed in this example, except that silver ripening was replaced by thiourea dioxide.

EXAMPLE-3

The preparation was performed similarly to that for Emulsion No. 1 of Example-1 up to the step of adding 4-hydroxy-6 -methyl-1,3,3a,7-tetrazaindene therein.

Further a series of popular additives for photographic use such as spreading agent, thickening agent and hardening agent were added therein, and the coating and drying were then made in the conventional process so that the Ag amount thereof can be at the ratio of 50 mg/cm$^2$ on sublayered polyethylene terephthalate film base together with a protective layer. At that time, the protective layer was devided by seven portions and one of them was used for the control and the other six of them were added with the compounds indicated in Table-3, respectively to prepare the samples.

Among these samples thus prepared, the samples just after coated and the other samples heat-treated at 55° C. and 80% R.H. and for the period of 27 hours, have respectively been exposed to light and then developed, and thus tested the preservability in the capability for a photographic material.

The results obtained are shown in Table-3. Sensitivities thereof are expressed in the values relative to that of Sample No. 23 just after coated taking the value of 100.

It can be found the fact from Table-3 that a photographic material having a high sensitivity and of which the preservability has greatly been improved can be obtained by combining the compounds of the invention with an emulsion in which the reduction-sensitization was processed inside the silver halide grains thereof, even if the compounds of the invention were added in the protective layer of said photographic material.

Also, there has been obtained the similar results from the same experiment as performed in this example, except that silver ripening was replaced by thiourea dioxide.

TABLE-3

| Sample No. | Compound added (mg/mol of AgX) | | Developed just after coated S | Fog | γ | Developed after heat-treated S | Fog | γ |
|---|---|---|---|---|---|---|---|---|
| 23 | None | | 100 | 0.05 | 2.3 | 65 | 0.03 | 2.2 |
| 24 | Compound 17 | 200mg | 98 | 0.04 | 2.3 | 94 | 0.04 | 2.3 |
| 25 | " | 1,000mg | 95 | 0.03 | 2.4 | 103 | 0.02 | 2.3 |
| 26 | Compound 39 | 200mg | 97 | 0.04 | 2.3 | 94 | 0.04 | 2.3 |
| 27 | " | 1,000mg | 94 | 0.02 | 2.4 | 102 | 0.02 | 2.4 |
| 28 | Compound 53 | 200mg | 99 | 0.04 | 2.3 | 95 | 0.04 | 2.3 |

TABLE-3-continued

| Sample No. | Compound added (mg/mol of AgX) | | Developed just after coated S | Fog | γ | Developed after heat-treated S | Fog | γ |
|---|---|---|---|---|---|---|---|---|
| 29 | " | 1,000mg | 96 | 0.03 | 2.4 | 105 | 0.02 | 2.4 |

EXAMPLE-4

Silver nitrate solution was added in the solution containing potasium bromide, potassium iodide and gelatin, taking the period of 60 minutes. At the point of time passed for 20 minutes after the precipitation was commenced, thiourea dioxide of 0.1 mg/mol of AgX was added further. The emulsion thus obtained was silver iodobromide emulsion containing 6 mol% of silver iodide in form of a polydispersed octahedral twin having the average diameter of 0.9μ.

After desalted, gold-sensitization and sulfur-sensitization were processed, and then 4-hydroxy-6-methyl-1,3,3a,7-tetrazaindene was added.

The emulsion thus obtained was devided by six portions and one of which was used for the control and five other portions were respectively added with the compounds indicated in Table-4. These six kinds of the emulsions were coated on and dried up respectively. At the time of coating, sensitizing dye [I], α-(1-benzyl-2,4-dioxy-3-imidazolidinyl)-α-pivalyl-2-chloro-5-[γ-(2,4-di-t-amylphenoxy)butylamide]acetanilide as to a yellow coupler and the popular additives for photographic use such as spreading, thickening and hardening agents were added, and then coated and dried up in the conventional process so that the coating ratio can be at Ag 20 mg/100 cm² on a sublayered cellulose triacetate film base, and thus Sample No. 30–No. 37 were prepared respectively.

Sensitizing dye [I]

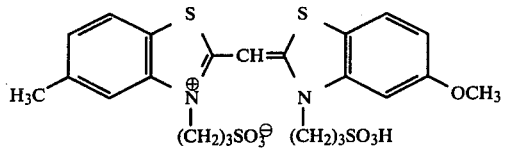

These samples were exposed to light through a blue wedge (for the period of 1/50 second) and then color-developed, bleach-fixed, washed and dried-up, and thus a yellow image was obtained respectively from each sample.

And, sensitometric tests were performed with each of both samples just after coated and the samples heat-treated at 55° C. and 80% R.H. and for 72 hours.

The results obtained are shown in Table-4. Sensitivities thereof are expressed in the values relative to that of Sample No. 30 just after coated taking the value of 100.

It can be found the fact from Table-4 that a color photographic material having a high sensitivity and of which the preservability has been greatly improved can be obtained by containing the compounds of the invention in emulsions reduced and sensitized inside the silver halide grains thereof.

On the other hand, such effects as above cannot be obtained from any sample using any compound other than but similar to those of the invention.

TABLE-4

| Sample No. | Compound added (mg/mol of AgX) | | Developed just after coated S | Fog | γ | Developed after heat-treated S | Fog | γ |
|---|---|---|---|---|---|---|---|---|
| 30 | None | | 100 | 0.04 | 0.65 | 70 | 0.03 | 0.62 |
| 31 | Compound 57 | 100mg | 98 | 0.04 | 0.65 | 90 | 0.03 | 0.63 |
| 32 | " | 200mg | 95 | 0.03 | 0.68 | 94 | 0.02 | 0.68 |
| 33 | " | 500mg | 90 | 0.02 | 0.73 | 98 | 0.02 | 0.73 |
| 34 | Compound 62 | 100mg | 99 | 0.04 | 0.65 | 90 | 0.03 | 0.62 |
| 35 | " | 500mg | 93 | 0.02 | 0.75 | 98 | 0.02 | 0.74 |
| 36 | Control compound 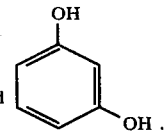 | 100mg | 95 | 0.04 | 0.67 | 68 | 0.03 | 0.63 |
| 37 | " | 500mg | 85 | 0.03 | 0.70 | 63 | 0.02 | 0.67 |

What is claimed is:

1. A silver halide photographic emulsion characterized in that it comprises silver halide grains reduction-sensitized in a process of growing the silver halide grains, and a compound represented by the following General Formula [I]:

General Formula [I]

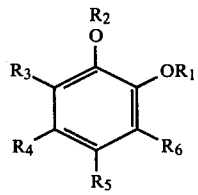

(wherein $R_1$ and $R_2$ are selected from the group consisting of a hydrogen atom, an alkyl group, an alkenyl group, an aryl group, an acyl group and a cycloalkyl group and $R_3$, $R_4$, $R_5$ and $R_6$ are selected from the group consisting of a hydrogen atom, a halogen atom, a hydroxy group, an alkyl group, an alkenyl group, a cycloalkyl group, an aryl group, an alkoxy group, an acyl group, a carboxyl group, an aldehyde group, an amino group, a sulfo group, an alkylthio group, an acylamino group, an aryloxy group, an arylthio group, an alkylamino group, an alkoxycabonyl group and a sulfonamide group.)

2. A silver halide photographic emulsion according to claim 1, the silver halide grains are reduction-sensitized by adding a reducing agent and/or a water-soluble silver salt to the emulsion.

3. A silver halide photographic emulsion according to claim 1, the silver halide grains are further sensitized by gold and/or sulfur.

4. A silver halide photographic emulsion according to claim 3, the sensitization by gold and/or sulfur is carried out, after completion of the reduction-sensitization of the silver halide grains.

5. A silver halide photographic emulsion according to claim 2, the reducing agent is thiourea dioxide or stannous chloride.

6. A silver halide photographic emulsion according to claim 2, the water-soluble silver salt is silver nitrate.

7. A method for producing a silver halide photographic emulsion comprising:

(1) reduction-sensitizing in a process of growing the silver halide grains and (2) adding a compound according to claim 1 to the silver halide photographic emulsion.

8. A method according to claim 7, reduction-sensitizing is carried out by adding a reducing agent and/or a water-soluble silver salt to the emulsion.

9. A method according to claim 8, the reducing agent is thiourea dioxide or stannous chloride.

10. A method according to claim 8, the water-soluble silver salt is silver nitrate.

11. A method according to claim 7, the silver halide grains are further sensitized by gold and/or sulfur.

12. A method according to claim 11, the silver halide grains are further sensitized by gold and/or sulfur after completion of the reduction-sensitization of the silver halide grains.

13. A light-sensitive silver halide photographic material comprising a support and a silver halide photographic emulsion comprising silver halide grains, reduction-sensitized in a process of growing the silver halide grains, and a compound according to claim 1.

14. A light-sensitive silver halide photographic material according to claim 13, the silver halide grains are reduction-sensitized by adding a reducing agent and/or a water-soluble silver salt to the emulsion.

15. A light-sensitive silver halide photographic material according to claim 13, the silver halide grains are further sensitized by gold and/or sulfur.

16. A light-sensitive silver halide photographic material according to claim 13, the silver-halide grains are further sensitized by gold and/or sulfur after completion of the reduction-sensitization of the silver halide grains.

17. A light-sensitive silver halide photographic material according to claim 14, the reducing agent is thiourea dioxide or stannous chloride.

18. A light-sensitive silver halide photographic material according to claim 14, the water-soluble silver salt is silver nitrate.

* * * * *